US010287809B2

(12) United States Patent
Holm et al.

(10) Patent No.: US 10,287,809 B2
(45) Date of Patent: May 14, 2019

(54) HINGE FOR A ROOF WINDOW, AND A ROOF WINDOW INCLUDING A SET OF HINGES

(71) Applicant: VKR Holding A/S, Hørsholm (DK)

(72) Inventors: Michael Galsgård Holm, Roskilde (DK); Klaus Kornerup, Birkerød (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 15/773,709

(22) PCT Filed: Nov. 4, 2016

(86) PCT No.: PCT/DK2016/050356

§ 371 (c)(1),
(2) Date: May 4, 2018

(87) PCT Pub. No.: WO2017/076416

PCT Pub. Date: May 11, 2017

(65) Prior Publication Data

US 2018/0320425 A1 Nov. 8, 2018

(30) Foreign Application Priority Data

Nov. 6, 2015 (DK) ..... 2015 70717

(51) Int. Cl.

| | |
|---|---|
| ***E04B 7/18*** | (2006.01) |
| ***E05D 11/00*** | (2006.01) |
| ***E05D 3/18*** | (2006.01) |

(Continued)

(52) U.S. Cl.

CPC ..... *E05D 11/00* (2013.01); *E04D 13/03* (2013.01); *E05D 3/02* (2013.01); *E05D 3/186* (2013.01);

(Continued)

(58) Field of Classification Search

CPC .. E05D 11/00; E05D 5/02; E05D 3/02; E05D 3/186; E05D 7/086; E05D 7/085;

(Continued)

(56) References Cited

U.S. PATENT DOCUMENTS 1,831,455 A * 11/1931 Kubler ..... E05D 3/02 49/166
2,225,178 A * 12/1940 Nicholson ..... E05D 3/10 16/367

(Continued)

FOREIGN PATENT DOCUMENTS

| | | |
|---|---|---|
| EP | 0089813 | 9/1983 |
| JP | H0552181 | 7/1993 |

OTHER PUBLICATIONS

International Search Report dated Oct. 12, 2017 issued in connection with PCT/DK2016/050356, pp. 1 to 13.

*Primary Examiner* — Basil S Katcheves
(74) *Attorney, Agent, or Firm* — Merek, Blackmon & Voorhees, LLC

(57) ABSTRACT

The hinge (10) is intended for a roof window having a frame and a sash, and has a frame hinge part (100) and a sash hinge part (200) configured to assume an angle relative to the frame hinge part (100). Each hinge part (100, 200) has a base plate (110, 210) with a guide track (112, 212) and a link (120, 220), the links (120, 220) being connected to each other at a bearing axle (123). Each link (120, 220) has a first hinged joint (121, 221) to the respective base plate (110, 210) and a sliding joint (122, 222) slidably received in the guide track (212, 112) in the base plate (210, 110) of the other hinge part (200, 100). A pick-up element (130, 230) is connected to the base plate (110, 210) in a second hinged joint (131, 231) and is biased by a spring (140, 240) to act on the sliding joint (222, 122) in the guide track (112, 212), for instance within a predefined angle interval.

21 Claims, 9 Drawing Sheets

(51) Int. Cl.

| | |
|---|---|
| ***E05D 7/082*** | (2006.01) |
| ***E05D 7/085*** | (2006.01) |
| ***E05D 7/086*** | (2006.01) |
| ***E04D 13/03*** | (2006.01) |
| ***E05D 3/02*** | (2006.01) |
| ***E05D 5/02*** | (2006.01) |

(52) U.S. Cl.
CPC ..... *E05D 5/02* (2013.01); *E05D 7/082* (2013.01); *E05D 7/085* (2013.01); *E05D 7/086* (2013.01); *E05Y 2800/744* (2013.01); *E05Y 2900/152* (2013.01)

(58) Field of Classification Search
CPC ... E05D 7/082; E04D 13/03; E05Y 2800/744; E05Y 2900/152
USPC ..... 52/200; 49/358
See application file for complete search history.

(56) References Cited

U.S. PATENT DOCUMENTS 2,376,965 A * 5/1945 Hellkvist ..... E05D 11/087 16/339
2,746,101 A * 5/1956 Lickteig ..... E05D 7/085 16/337
3,099,036 A * 7/1963 Bank ..... E05D 7/085 16/371
3,845,585 A * 11/1974 Cecil ..... E05D 15/48 49/139
4,069,548 A * 1/1978 Bierlich ..... E05D 7/086 16/341
4,106,237 A * 8/1978 Bierlich ..... E05D 3/18 49/249
4,429,494 A * 2/1984 Kornerup ..... E05F 1/1075 49/346
4,654,931 A * 4/1987 Sonneborn ..... E05D 7/086 16/260
5,097,629 A * 3/1992 Guhl ..... E04D 13/0354 49/324
5,568,702 A * 10/1996 Frank ..... E04D 13/0357 49/153
6,442,896 B1 * 9/2002 Chapin, III ..... E04D 13/0354 49/192
2010/0071163 A1 * 3/2010 Florek ..... E05D 1/04 16/342
2011/0314743 A1 * 12/2011 Warner ..... E04F 17/06 49/358
2012/0036783 A1 * 2/2012 Ryberg ..... E04D 13/0354 49/358
2018/0313122 A1 * 11/2018 Ashraf ..... E05D 11/00

* cited by examiner

HINGE FOR A ROOF WINDOW, AND A ROOF WINDOW INCLUDING A SET OF HINGES

The present application is a 371 application of International Application No. PCT/DK2016/050356 filed on Nov. 4, 2016 which claims priority from foreign application No. PA 2015 70717 filed in Denmark on Nov. 6, 2015.

FIELD OF THE INVENTION

The present invention relates to a hinge for a roof window having a frame and a sash, said hinge comprising a frame hinge part and a sash hinge part configured to assume an angle relative to the frame hinge part, the frame hinge part and the sash hinge part each comprising a base plate with a guide track and a link, the links being connected to each other at a bearing axle, each link including a first hinged joint to the respective base plate and a sliding joint slidably received in the guide track in the base plate of the other hinge part. The invention furthermore relates to a roof window including a set of hinges.

BACKGROUND ART

Basically, roof windows may be provided in a number of varieties and include more or less complicated structures in order to allow opening of the sash and to fulfil other functions, such as ventilation, while permitting cleaning of the outside of the pane from inside the building. The varieties include roof windows of the pivoting type, the hinge axis being either located at the centre or displaced from the centre of the window, and top-hung roof windows that pivot for cleaning by means of an intermediate frame.

These requirements are made possible by the provision of a hinge with a particular pattern of movements, which in turn makes it possible to establish an overlap between the cover members fastened to the frame and the counterpart cover members fastened to the sash in the closed position of the roof window.

One very well-proven type of hinge is the pivot hinge including a guidance on the frame hinge part cooperating with a slide rail on the sash hinge part. Such pivot hinges are for instance disclosed in Applicant's EP 1 038 083 B1 and EP 1 781 883 B1, and are very versatile as regards operational areas and adaptation of components. Examples of roof windows incorporating such adapted hinges are shown in Applicant's published European patent applications EP 2 770 146 A1 and EP 2 770 149 A1.

However, as the traditional pivot hinges to some extent rely on frictional forces to operate correctly, it is desirable to utilize an alternative configuration of the hinge in certain fields of application, in which the desired pattern of movements is provided by a linkage mechanism. The use of hinges including linkage mechanisms is traditionally most often known from the furniture field, but such hinges are also well-known to use for roof windows. Prior art examples include Danish patent No. 114 321, U.S. Pat. No. 4,446,597, and Applicant's European patents EP 22 657 B1 and EP 89 813 B1. The latter document discloses a hinge of the kind mentioned in the introduction.

Although the linkage mechanisms in the above examples are to some extent capable of providing the kinematic pattern and force transmission aimed at, there is still room for improvement.

SUMMARY OF THE INVENTION

With this background it is an object of the present invention to improve a hinge of the kind mentioned in the introduction with respect to controlling the pattern of movements and the output forces of the linkage mechanism of the hinge.

In a first aspect, this and further objects are met by the provision of a hinge, which is characterized in that at least one hinge part is provided with a pick-up element biased by a spring to act on a selected part of the hinge.

In the context of the application, a pick-up element is to be understood as an element, which is attached to one part of the hinge, and applies a force to another part of the hinge, in a way that would not be present, if not for the pick-up element. An example of such an element is the pick-up of a phonographic record player, in which the pick-up is connected to the base of the record player, and applies a force to the record on the turntable.

By providing at least one hinge part of the hinge with a spring-biased pick-up, a very precise control of the force during the movement of the sash hinge part relative to the frame hinge part is achieved. Compared to prior art systems incorporating pivot hinges, the use of excessive frictional action and other, more elaborate arrangements for controlling the movement is avoided.

In a presently preferred embodiment, said selected part of the hinge is chosen from the group consisting of the link, the sliding joint of the other hinge part in the guide track and the bearing axle.

Other presently preferred embodiments and further advantages will be apparent from the following detailed description and the dependent claims.

BRIEF DESCRIPTION OF DRAWINGS

The invention will be described in more detail below by means of non-limiting examples of embodiments and with reference to the schematic drawing, in which.

DETAILED DESCRIPTION OF THE INVENTION

Figure 1:
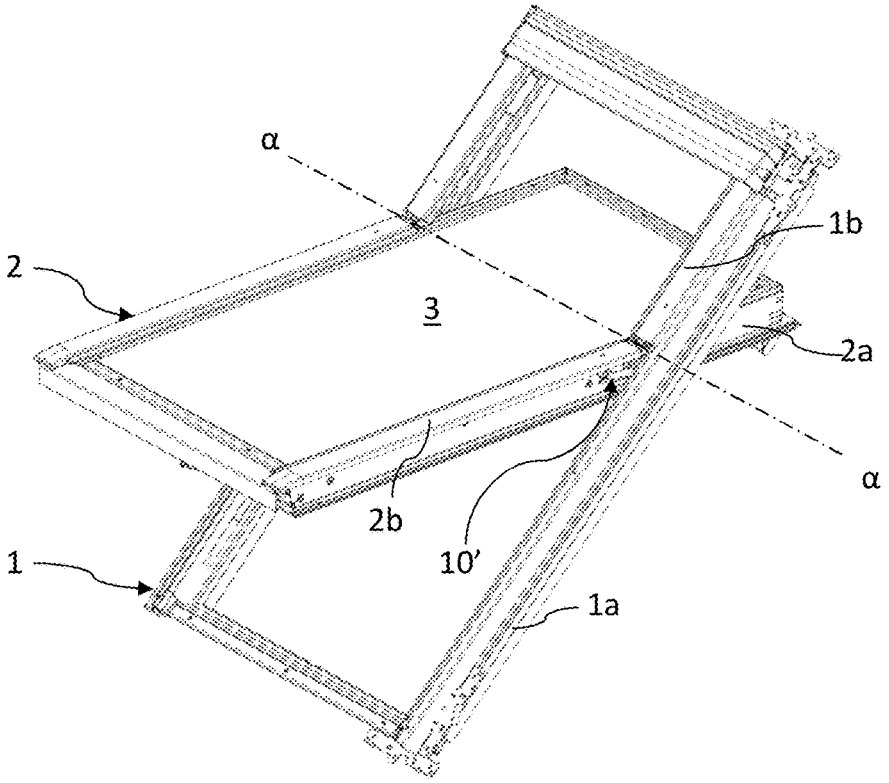
Fig. 1 (PRIOR ART)
FIG. 1 shows a perspective view of a roof window with a prior art hinge.

In the following, embodiments of the inventive hinge generally designated 10 will be described in further detail. For reference, a window with a prior art hinge 10' is shown in FIG. 1. Such a hinge 10' and other parts of the window which are applicable also to a window according to the invention are described in Applicant's published European patent applications EP 2 770 146 A1 and EP 2 770 149 A1 to which reference is hereby explicitly made. It is hence to be understood that the hinge 10 according to the invention replaces the prior art hinge 10' at one or both sides of the window.

In a manner known per se, the window comprises a sash 2 carrying a glazing in the form of a pane 3 and a frame 1. The window is intended to be built into a surface, which is inclined with respect to the horizontal, typically a roof, and the window will in the following be referred to as roof window. At a position between the top and centre of the window, there is a hinge connection between the frame 1 and the sash 2. The hinge connection in FIG. 1 comprises a set of two prior art hinges, of which one hinge 10' is visible. The frame 1 and sash 2 is each formed by four members of which one frame side member 1*a* and one sash side member 2*a* are indicated. The sash 2 is openable with respect to the frame 1, as the sash 2 may be moved from a closed position, in which e.g. the sash side member 2*a* is substantially parallel with the frame side member 1*a*, to an open position, in which the sash side member 2*a* forms an angle with the frame side member 1*a*. During this movement the sash 2 rotates about a hinge axis α situated at the hinge connection. As indicated in FIG. 1, the hinge axis α is located between a centre axis and the top of the roof window, preferably in the interval ⅓ to ⅔ of the distance between the centre axis and the top, most preferred substantially at ½ of the distance between the centre axis and the top. Other positions of the hinge axis is of course conceivable, for instance at the centre of the roof window.

To protect the interior and the components of the window itself and to ascertain weather-proof transition to the surrounding roofing, the roof window comprises a covering arrangement, including flashing members (not shown) and cladding elements of which a frame side cladding element 1*b* and sash side cladding element 2*b* are shown.

Other parts of the roof window not described in the present application but which are nevertheless directly applicable also to the roof window according to the invention include auxiliary equipment such as a lifting device for assisting the movement of the sash 2 from the closed position to an open position described in the above-mentioned EP applications.

From a closed position, the user operates the operating device of the window. The operating device typically comprises a handle (not shown) connected with the sash bottom member and/or an operating and locking assembly including a ventilation flap at the sash top member with a lock mechanism to interact with a striking plate on the frame top member. As will be described in further detail below, the hinge 10 exerts a moment on the sash 1, and in combination with the force, and hence moment, exerted by the user operating the operating device, the moment resulting from the weight of the sash 1 and pane 3 is overcome, along with any frictional forces present. All in all, the opening operation entails that the sash 1 is moved from a closed position to an open position as represented by FIG. 1, in which the sash plane forms an opening angle with the frame plane. Closing the window from the open position entails the opposite movement of the sash 1. It is possible to position the sash 2 in a number of arbitrary opening positions, in which the sash 2 is held stable relative to the frame 1. The sash 2 is also able to be rotated substantially through 180° to allow cleaning of the outside of the pane 3 from the inside of the building in which the roof window is installed.

Referring now to FIGS. 2 to 5, a first embodiment of a hinge 10 according to the invention will be described in detail.

Figure 2:
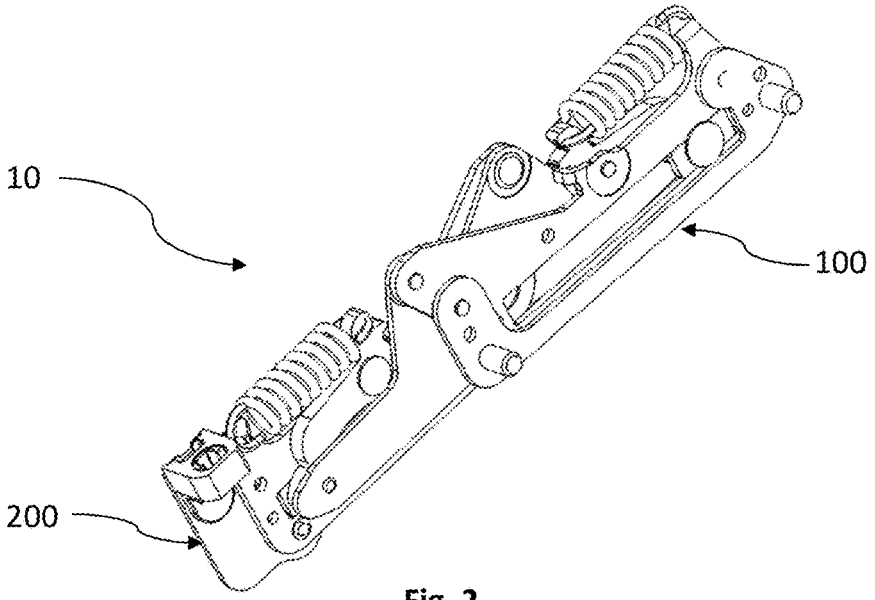
FIG. 2 shows a perspective view of a first embodiment of the hinge according to the invention.
Figure 3:
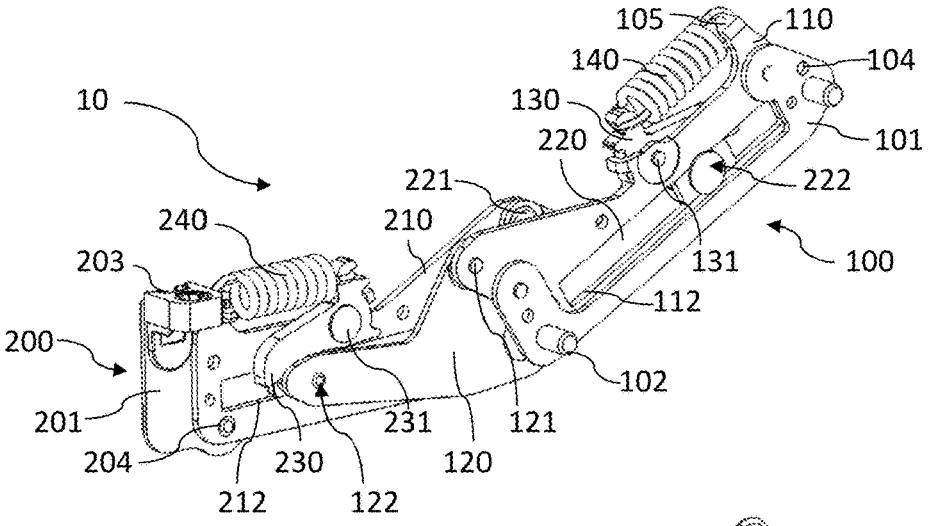
FIGS. 3 to 5 show views of the hinge of FIG. 2 in three different positions.
Figure 4:
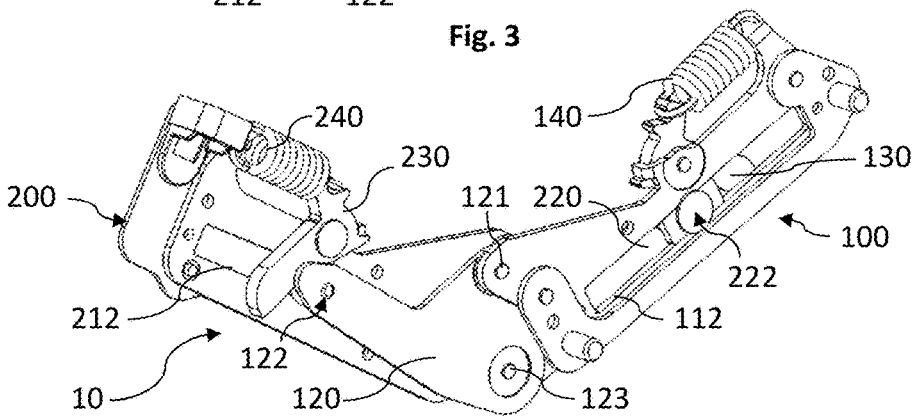

The hinge 10 comprises a frame hinge part 100 and a sash hinge part 200 configured to assume an angle relative to the frame hinge part 100. The hinge 10 forms part of a set of hinges, of which the frame hinge part 100 of each hinge 10 is configured to be fastened to the frame side member 1*a* of the frame 1 of the roof window by fastening means 102, at a location chosen to provide the desired position of the hinge axis α, and the sash hinge part 200 is correspondingly configured to be fastened to the sash side member 2*a*. The hinge 10 is shown as it will be positioned in a roof window installed in a roof having an inclination of approximately 40°. FIG. 2 corresponds to the closed position of the roof window; FIG. 3 to an opening angle of 30°; FIG. 4 to an opening angle of 60°; and FIG. 5 to an opening angle of substantially 180°, that is, when the sash 2 has been rotated to allow cleaning of the outside of the pane 3 from the inside of the building.

The hinge 10 according to the invention includes a linkage mechanism having a configuration allowing a very accurate control of the force conditions of the kinematic pattern and output force. To that end the frame hinge part 100 and the sash hinge part 200 each comprises a base plate 110, 210 with a guide track 112, 212 and a link 120, 220. The links 120, 220 are connected to each other at a bearing axle 123 (visible in FIGS. 4 and 5). As will be apparent from the below description, the bearing axle 123 enables a rotational relative movement between the links 120, 220 and is not fixed relative to any of the hinge parts 100, 200 and is thus able to move during the opening and closing movements.

Each link 120, 220 includes a first hinged joint 121, 221 to the respective base plate 110, 210 and a sliding joint 122, 222 slidably received in the guide track 212, 112 in the base plate 210, 110 of the other hinge part 200, 100. By the term "hinged joint" is to be understood that the connection is purely or at least mainly rotational. The term "sliding joint" is utilized to denote that the connection involves a translational movement; however, it is to be understood that the parts are also able to rotate relative to each other. In the embodiment shown, each link 120, 220 is formed as an angular element with an apex and two legs, the bearing axle 123 being provided at the apex and the first hinged joint 121, 221 being provided at one leg, and the sliding joint 122, 222 at the other leg.

According to the general principle underlying the invention, at least one hinge part 100, 200 is provided with a pick-up element 130, 230.

In the embodiment shown, the frame hinge part 100 and the sash hinge part 200 are both provided with a pick-up element 130, 230. The pick-up elements 130, 230 are connected to the respective base plate 110, 210 in a second hinged joint 131, 231 and biased by a spring 140, 240 to act on the sliding joint 222, 122 of the other hinge part 200, 100 in the guide track 112, 212.

In principle, the pick-up element may be formed as any suitable element which is attached to one part of the hinge and applies a force to another part of the hinge, in a way that would not be present if not for the pick-up element. Hence, the pick-up element may, when subjected to a force in one direction, give rise to a force in the same or in another direction, again depending on the mounting in the hinge.

Figure 17:
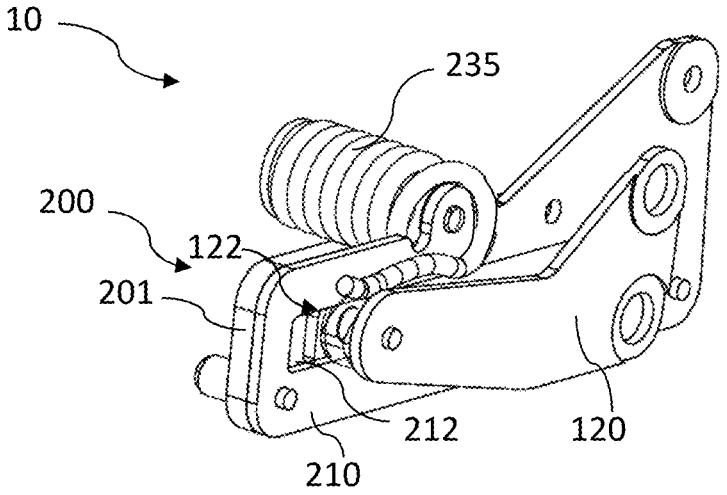
FIG. 17 is a perspective view of details of another embodiment of the hinge according to the invention.

Correspondingly, the spring bias may be accomplished in any suitable way. Typically, the spring will be a tension or compression spring, depending on the mounting. In an alternative embodiment, shown in FIG. 17, the spring is integrated into the pick-up element 135 which here takes the form of a torsion spring.

Figure 18:
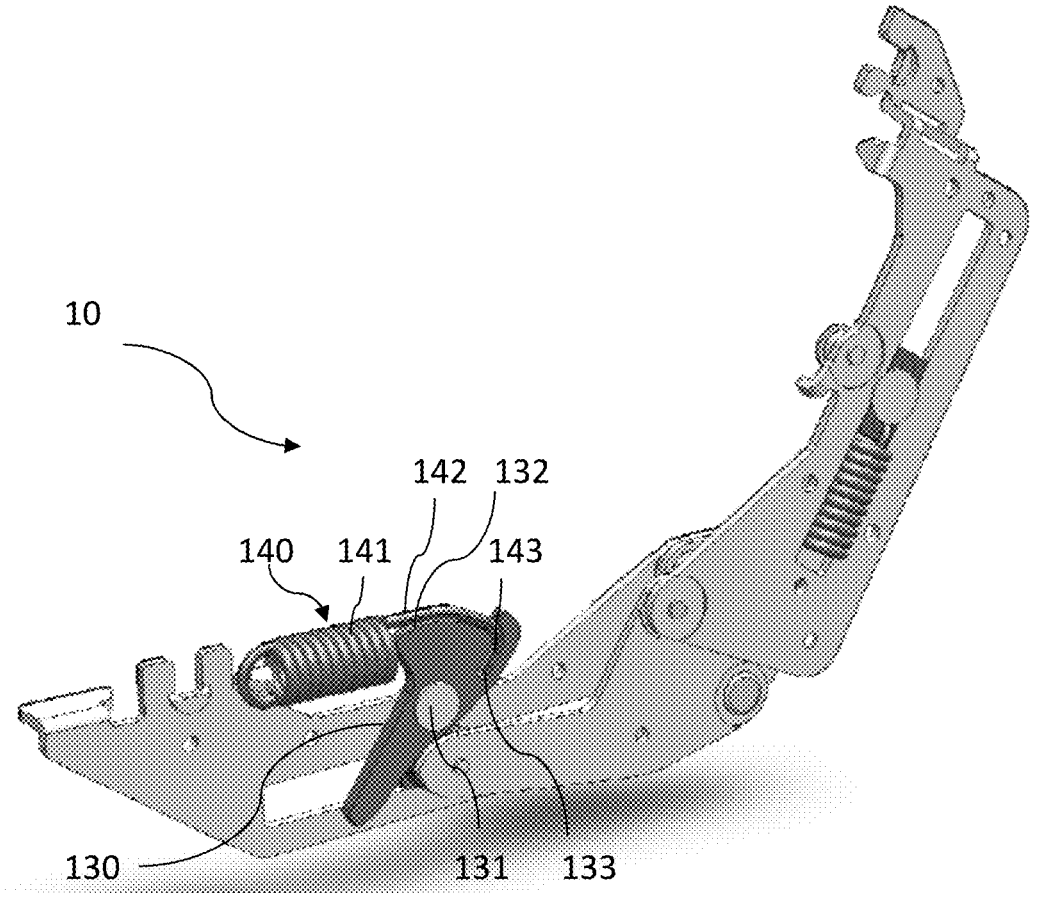
FIG. 18 is a perspective view of a further embodiment of the hinge according to the invention.

Another embodiment is shown in FIG. 18, in which the pick-up element 130 is provided with a curved surface 132 to interact with a straight portion 142 of the spring 140, protruding from a main body 141 of the spring 140. In the specific embodiment, the pick-up element 130 is provided with a recess 133 to accommodate an end portion 143 of the spring 140. The curved surface 132 provides for a smooth rolling-on, rolling-off action of the straight portion 142 of the spring 140 contacting the curved surface 132. The radius of curvature of the curved surface 132 and the distance from the second hinged joint 131 are chosen so that a satisfactory movement is attained.

In one presently preferred embodiment, each sliding joint 222, 122 comprises two components, as seen in FIGS. 16*a-d*. A first block 222*a*, which is preferably made of a polymeric material, even more preferably made of a POM and Teflon® composite material, interacts with the guide track 112, 212. The block 222*a* is preferably made to have a high strength and durability, while maintaining relatively low frictional forces. Examples of commercially available materials in this group include PA6 NC (Promyde B30 NC100), POM (Hostaform 59362), POM TF (Hostaform C9021 TF), TPU (Isoplast 302) and TPU GF30 (Estaloc 59380). In a preferred development of this embodiment, the first block 222*a* is rectangular or square, in order to enable a stable movement in the guide track 112, 212. A second block 222*b* interacts with the pick-up element 130, 230, and is preferably made of a reinforced polymer, preferably PA6 reinforced by up to 30% glass fibers. The second block 222*b* is preferably made to withstand high forces, and as such should be made of strong and abrasion resistant materials. Examples of a commercially available materials in this group include PA6 30GF (Durethan BKV 30), PA66 GF30 (Zytel 70G30HSLR), and TPU (Pearlthane 11T85, Estane GP52DT, Estane GP72DB NAT 012). The second block 222*b* can have any shape, but is in the shown embodiment substantially elliptical, as this provides a curvature, which interacts in a smooth and stable manner with the curved surface 2303 of the pick-up element 130, 230.

Other examples of modifying the frictional forces in the track 112, 212 include providing the track with one or more narrowed sections.

The pick-up element 130, 230 comprises a defined surface 1305, 2305, which dictates the force-transmitting properties of the pick-up element 130, 230.

In the first and second embodiments shown, the springs 140, 240 are connected to a respective spring hook 105, 205 on the base plate 110 of the frame hinge part 100 and the base plate 210 of the sash hinge part 200, respectively.

Figure 5:
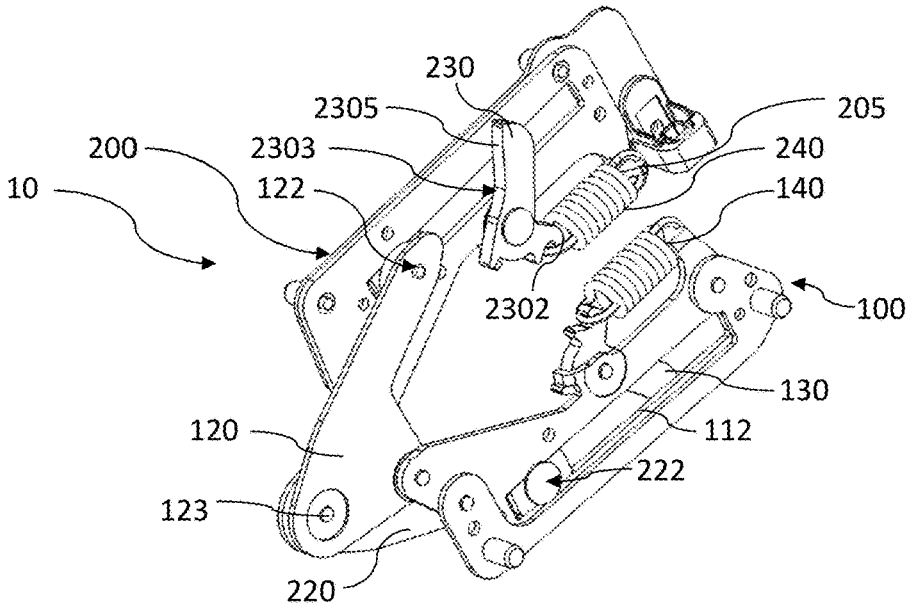

Furthermore, in the embodiments shown, each pick-up element 130, 230 is provided with a curved surface 2303, of which only the defined surface 2305 of the pick-up element 230 of the sash hinge part 200 of the first embodiment is indicated in FIG. 5, facing the sliding joint 222, 122 of the other hinge part 200, 100. The shape of the curved surface may be formed according to specifications, and conceivable designs are described below in connection with the second embodiment of the hinge 10. In some embodiments, the shape of the curved surface enables a force transmission specific for one type of window. In other embodiments, the curved surface will be shaped differently, in order to enable a different force transmission, for another window type, for example a roof window for a roof having a different inclination angle. In both of the shown embodiments, the pick-up elements 130, 230 are each provided with a recess, of which only the recess 2302 of the pick-up element 230 of the sash hinge part 200 of the first embodiment is indicated in FIG. 5, for cooperating with the spring 140, 240 and an opening (not shown) for cooperating with the second hinged joint 131, 231. The opening in the pick-up elements 130, 230 of the first embodiment may simply be formed as a circular aperture to receive a pin or axle fastened to the respective base plate 110, 210.

In the first embodiment, each pick-up element 130, 230 is substantially L-shaped and the second hinged joint 131, 231 is provided at the intersection between the legs of the L-shape, the recess 2302 for cooperating with the spring 140, 240 being provided at one leg of the L-shape and the curved surface 2303 facing the sliding joint 222, 122 of the other hinge part 200, 100 on the other.

With the specific arrangement of the pick-up elements 130, 230 of the first embodiment, the springs 140, 240 are provided as tension coil springs. Referring in particular to FIG. 5 and the spring 240 of the sash hinge part 200, the spring 240 has a relaxed condition when the recess 2302 is closer to the spring hook 205 of the base plate 210 of the sash hinge part 200. Corresponding considerations applies to the frame hinge part 100 and to the hinge parts 100, 200 of the second embodiment. The springs have a given spring characteristic that may be constant, linear, progressive or degressive according to specifications. In other, not-shown arrangements other spring types, including compression springs, are conceivable.

Hence, during the opening movement, the bias of the springs 140, 240 exerts a pushing force on the respective sliding joint 222, 122, and in turn, this force is transmitted into a moment acting on the sash 2 in the opening direction and thereby assists in the opening procedure. This is indicated by the appearance of the springs 140, 240 in FIG. 2 in which the springs 140, 240 are extended, over the increasingly relaxed conditions in FIGS. 3 and 4 to the fully relaxed condition in FIG. 5.

Comparing the position of the sliding joints 122, 222 in the track 212, 112 in FIG. 5 relative to FIGS. 2 to 4, it appears how the pick-up element 130, 230 acts on the sliding joint 222, 122 only within a predefined angle interval in the embodiment shown. Thus, the pick-up elements 130, 230 are no longer in contact with the respective sliding joint 122, 222 in FIG. 5. The upper limit of the predefined angle interval may be chosen according to specifications, and in the first embodiment shown, the upper limit of the predefined angle interval is approximately 60°, thus corresponding substantially to the position shown in FIG. 4.

Mounting of the hinge 10 in a roof window may in principle be carried out in any suitable manner. In order to ease the mounting, the specific hinge function is separated from the fastening function in the first embodiment in that at least one of the frame hinge part 100 and the sash hinge part 200 comprises a mounting plate 101, 201 for connection to the base plate 110, 210 by means of connection means 104, 204. In the first embodiment, the mounting plate 201 of the sash hinge part 200 is provided with two spigots 202 and the connection means to the base plate 210 is in the form of rivets 204 to provide a solid and reliable connection. The connection means 104 of the frame hinge part 100 is releasable such that the mounting plate 101 is able to be fastened separately to the frame of the roof window and the remaining components of the hinge including the base plate 110 are then connected to the mounting plate 101 in a subsequent operation. Such a releasable connection is for instance described in Applicant's German utility model DE202005020048U1 and specific reference is made to the description of the embodiment therein. The connection of the frame side cladding element 1*b* and sash side cladding element 2*a* is then carried out by introducing appropriate anchoring means into holding clips 103, 203 on the base plates 110, 210.

Figure 19:
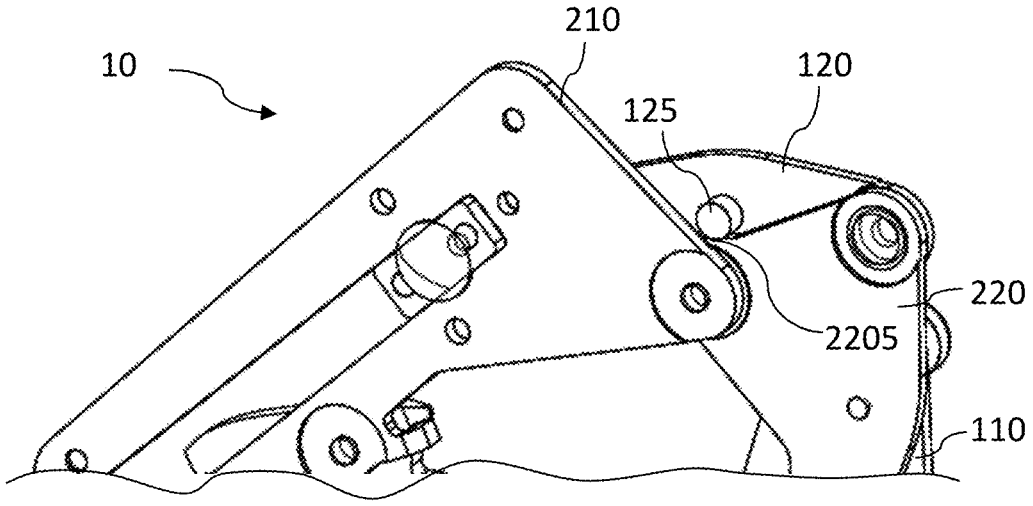
FIG. 19 is a schematic partial perspective view of a hinge in a still further embodiment of the invention.

During mounting of the hinge 10, it is advantageous that the installer maintains control of the components of the roof window such that the sash 2 is at all times prevented from rotating beyond 180°. To this end, the further embodiment shown in FIG. 19 is particularly advantageous. Here, a stop in the form of a rivet 125 mounted to the link 120 on the frame side will abut a well-defined abutment surface 2205 on the link 220 on the sash side. It is conceivable to have a rivet also on the link 220 on the sash side, to abut an abutment surface of the link 120 on the frame side. The rivet or rivets may also be positioned such that the sash is allowed to rotate until another angle than 180°, for instance 175° or 185°.

Referring now to FIGS. 6 to 15, a second embodiment of the hinge 10 according to the invention will be described. Only differences relative to the first embodiment will be described in detail; elements having the same or analogous function will be denoted by the same reference numerals.

Figure 6:
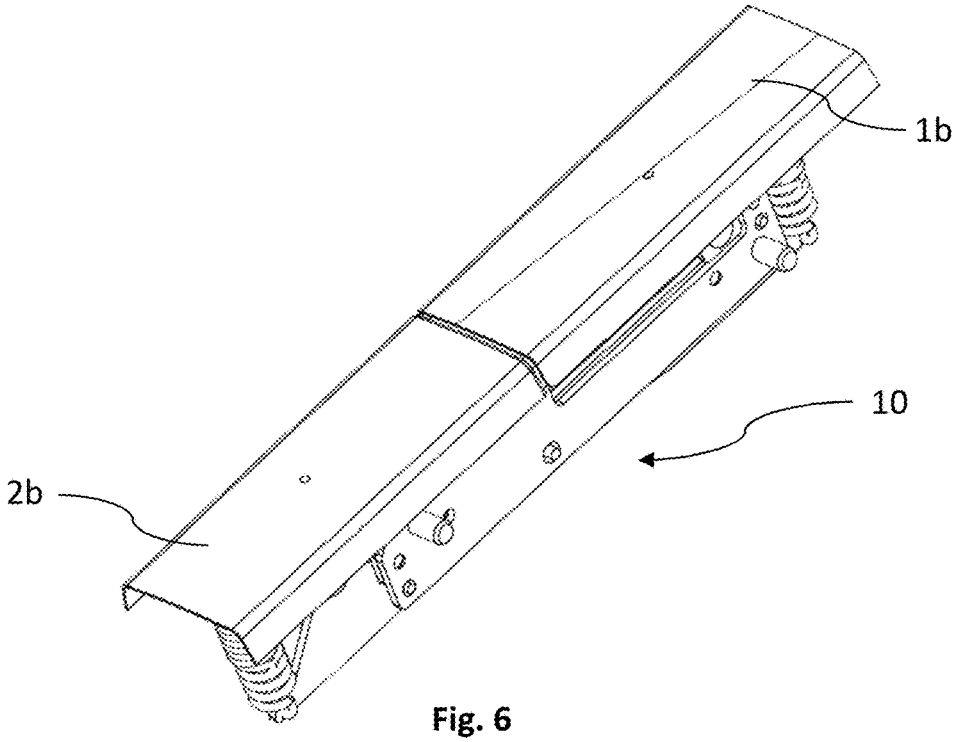
FIG. 6 is a view corresponding to FIG. 2, of a second embodiment of the hinge according to the invention, including covering parts of the frame and sash of the window.
Figure 7:
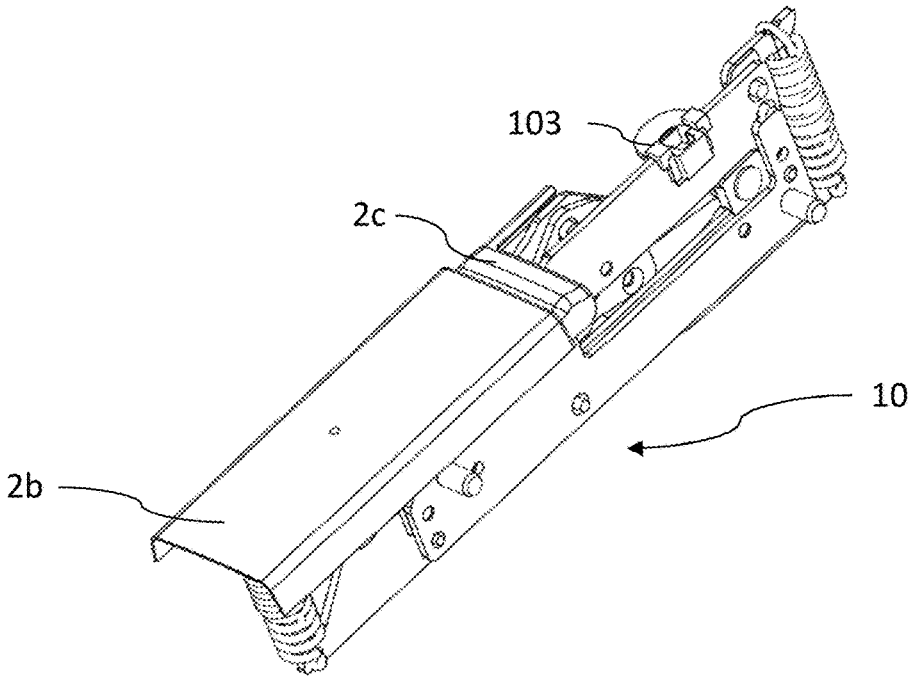
FIG. 7 is a view corresponding to FIG. 6, with the frame covering part removed.
Figure 8:
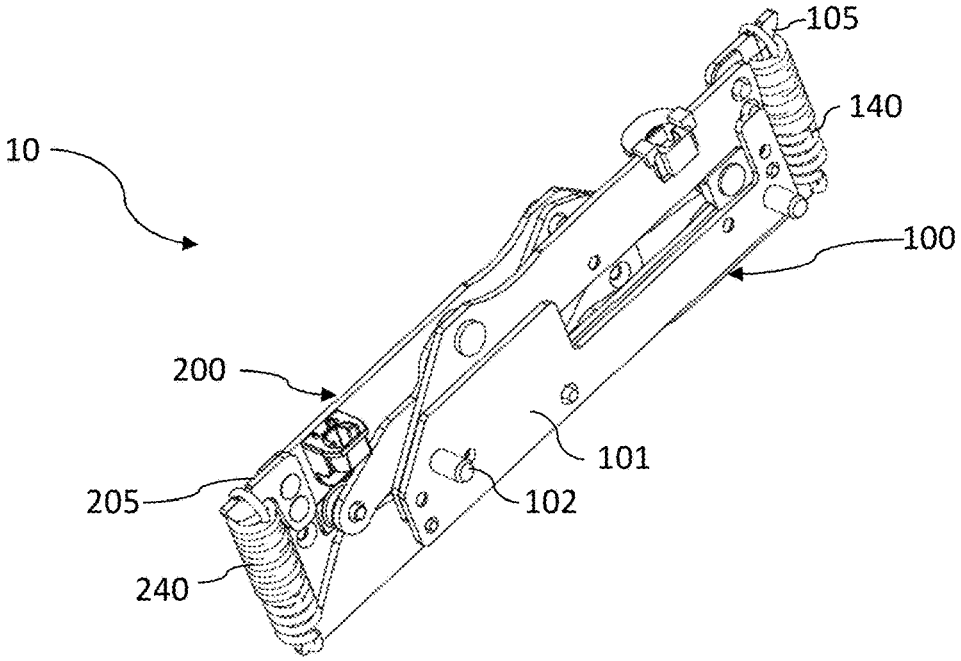
FIG. 8 shows a perspective view of the hinge in the second embodiment.
Figure 9:
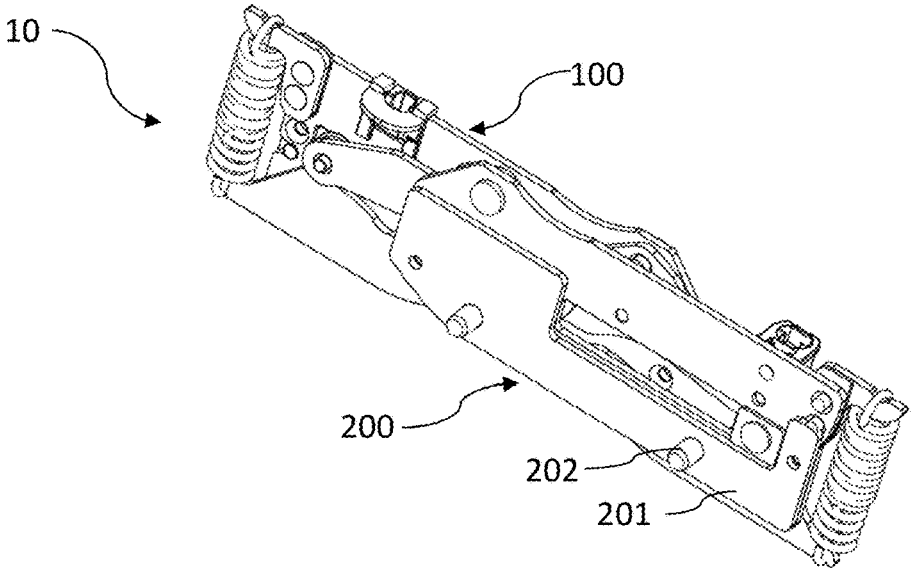
FIG. 9 shows a perspective view of the hinge of FIG. 8, from another angle.

From FIGS. 6 and 7 it also emerges how the frame side cladding element 1*b* and sash side cladding element 2*b* interact with each other; a cranked portion 2*c* of the sash cladding element 2*b* ensures a tight and flush transition between the sash cladding element 2*b* and the frame cladding element 1*b* in the closed position of the roof window. At the same time, the movement pattern of the hinge allows that the sash cladding element 2*b* is able to be retracted from its position under the frame cladding element 1*b* during the opening movement of the sash 2 relative to the frame 1, and conversely, be inserted under the frame cladding element 1*b* at the final stage of the closing movement.

The main difference in the second embodiment relative to the first embodiment resides in the configuration of the pick-up element and its connection to the base plate of the frame hinge part 100 and the sash hinge part 200, respectively.

In the second embodiment, each pick-up element 130, 230 is formed as a substantially longitudinal element and the second hinged joint 131, 231 is provided at one end and the recess 1302 for cooperating with the spring 140, 240 at the other, the curved surface 2303 facing the sliding joint 122 of the other hinge part 100 being provided at a top edge between the ends of the pick-up element 130, 230.

Figure 11:
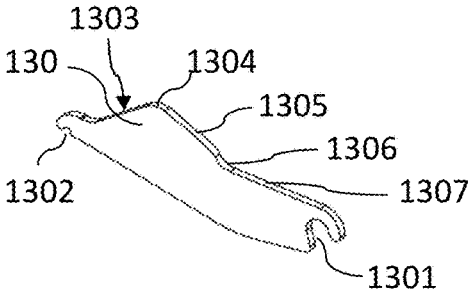
FIGS. 11 to 14 are perspective views of alternative embodiments of a detail of the hinge of FIG. 9.

Referring in particular to FIG. 11, the curved surface 1303 of the pick-up element 130 of the second embodiment comprises an apex point 1304, a first inclined portion 1305, at least one groove point 1306, a second inclined portion 1307 and an opening 1301. As mentioned in the above, the first inclined portion 1305 defines the force-transmitting properties of the pick-up element.

Figure 12:
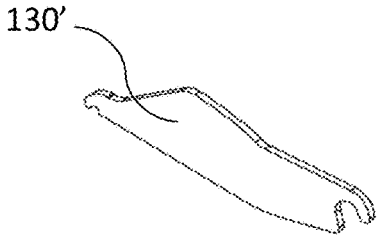
Figure 13:
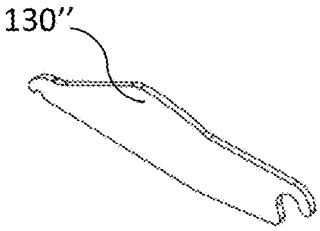
Figure 14:
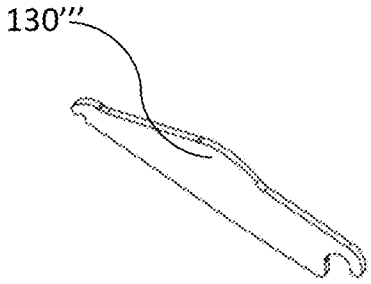

Alternative profiles of the curved surface 1303 shown in FIG. 11 are indicated in FIGS. 12 to 14.

In a roof window including a set of hinges 10 according to the first or second embodiments described in the above, a plurality of pick-up elements 130; 130'; 130"; 130''' may be provided, wherein the curved surface 1303 has a configuration adapted to a specific range of roof inclinations.

Figure 10:
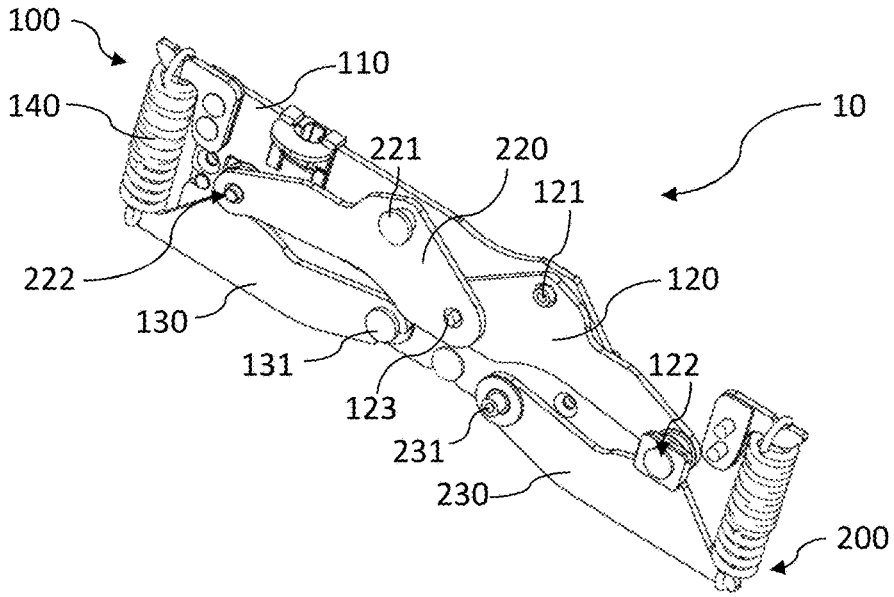
FIG. 10 is a view corresponding to FIG. 9, with some parts of the hinge removed.

In the hinge 10 of the second embodiment, the pick-up element 130 shown in its mounted position in FIG. 10 and separately in FIG. 11 is profiled to match a roof inclination of approximately 15°. The first inclined portion 1305 is relatively steep. If deemed convenient, the pick-up element 130 may be replaced by another pick-up element of the plurality provided with the roof window, advantageously by the pick-up element 130" designed for roof inclinations of approximately 45°, having a less steep first inclined portion. In comparison, the pick-up element 130' of FIG. 12 is designed for a roof inclination of approximately 33° and the pick-up element 130''' of FIG. 14 is designed for a roof inclination of approximately 60°.

Figure 15:
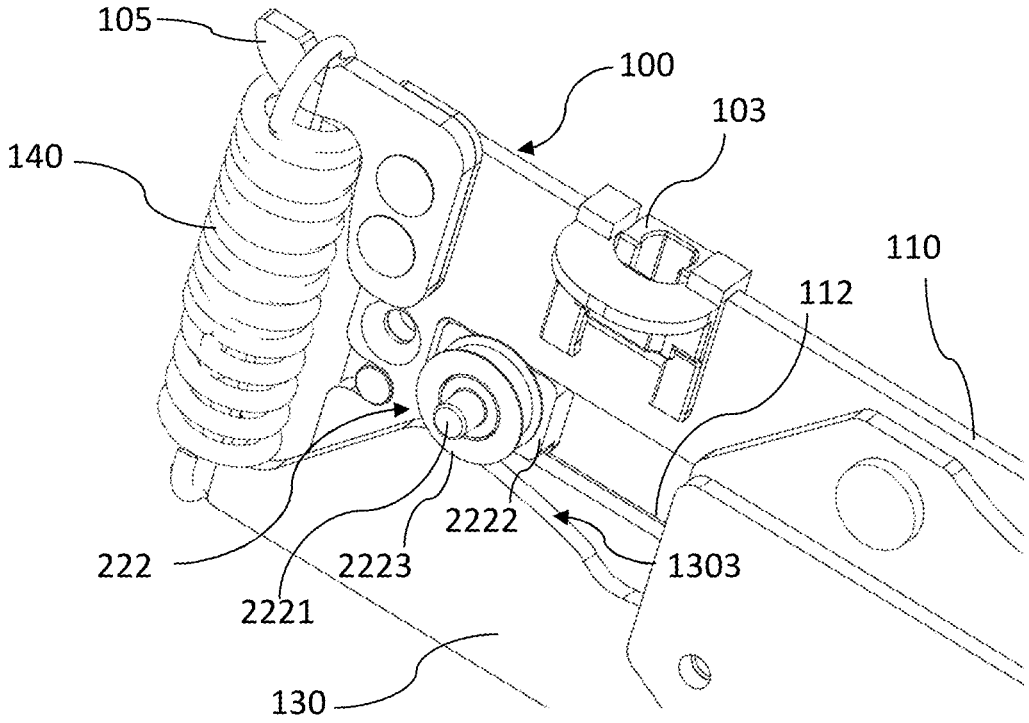
FIG. 15 shows a partial perspective view, on a larger scale, of details of the hinge of FIG. 9.
Figure 16A:
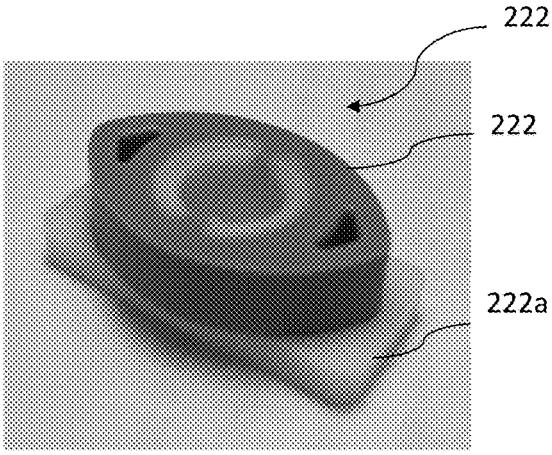
FIGS. 16*a-d* show partial perspective view, on a larger scale and from various angles, of details of the hinge of FIGS. 2 to 5.
Figure 16B:
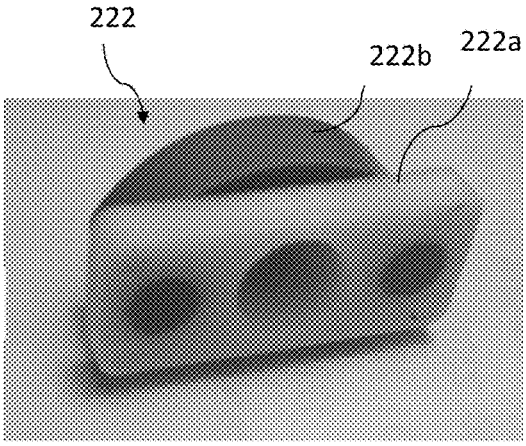
Figure 16C:
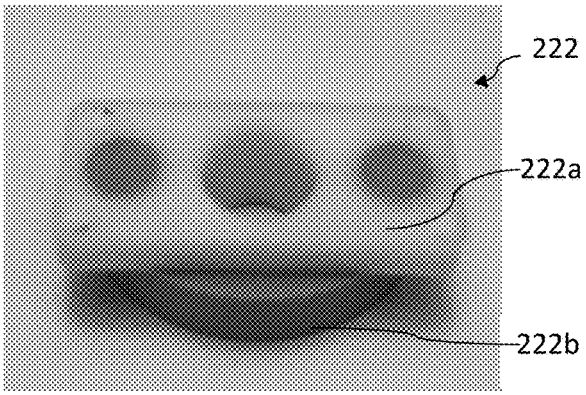
Figure 16D:
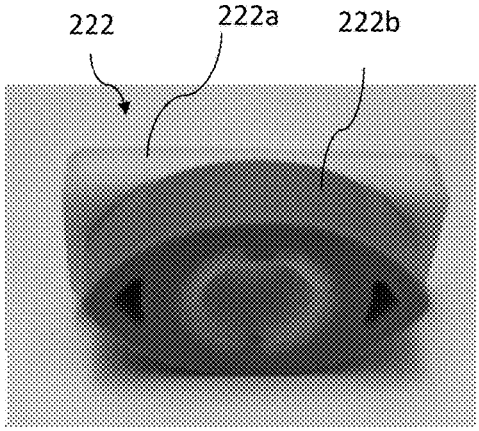

Referring to the detailed view of FIG. 15, the details of the sliding joint 222 of the sash hinge part 200 of the second embodiment of the hinge 10 are shown. Corresponding considerations apply to the frame hinge part 100 and to the hinge parts 100, 200 of the first embodiment. The sliding joint 222 comprises a pin 2221 connected to a substantially rectangular block 2222 slidably received in the guide track 112 of the other hinge part 100 and a wheel 2223 interacting with the defined surface 1305 of the curved surface 1303 of the pick-up element 130. Although not shown, the wheel 2223 of the sliding joint 222 and/or the defined surface 1305 of the pick-up element 130 may in not-shown embodiments be provided with force transmitting means, preferably as a toothed gear or a rack-and-pinion transmission.

It should be noted that the above description of preferred embodiments serves only as an example, and that a person skilled in the art will know that numerous variations are possible without deviating from the scope of the claims.

The invention claimed is:

1. A hinge (10) for a roof window having a frame and a sash, said hinge comprising:

a frame hinge part (100) and a sash hinge part (200) configured to assume an angle relative to the frame hinge part (100), the frame hinge part (100) and the sash hinge part (200) each comprising a base plate (110, 210) with a guide track (112, 212) and a link (120, 220), the links (120, 220) being connected to each other at a bearing axle (123), each link (120, 220) including a first hinged joint (121, 221) to the respective base plate (110, 210) and a sliding joint (122, 222) slidably received in the guide track (212, 112) of the base plate (210, 110) of the other hinge part (200, 100), characterized in that at least one hinge part (100, 200) is provided with a pick-up element (130, 230; 135) biased by a spring (140, 240) to act on a selected part of the hinge (10), said selected part of the hinge (10) being the sliding joint (222, 122) of the other hinge part (200, 100) in the guide track (112, 212), the pick-up element (130, 230) is connected to the base plate (110, 210) in a second hinged joint (131, 231) and acts on the sliding joint (222, 122) of the other hinge part (200, 100), and the pick-up element (130, 230) acts on the sliding joint (222, 122) only within a predefined angle interval.

2. A hinge according to claim 1, wherein the spring is integrated in the pick-up element (135).

3. A hinge according to claim 1, wherein the frame hinge part (100) and the sash hinge part (200) are both provided with a pick-up element (130, 230).

4. A hinge according to claim 3, wherein each pick-up element (130, 230) is provided with a curved surface (2303; 1303) facing the sliding joint (222, 122) of the other hinge part (200, 100).

5. A hinge according to claim 4, wherein the curved surface (1303) comprises an apex point (1304), a first inclined portion (1305), at least one groove point (1306), and a second inclined portion (1307).

6. A hinge according to claim 4, wherein each pick-up element (130, 230) is provided with a recess (2302; 1302) for cooperating with the spring (140, 240) and an opening (1301) for cooperating with the second hinged joint (131, 231).

7. A hinge according to claim 6, wherein each pick-up element (130, 230) is substantially L-shaped and the second hinged joint (131, 231) is provided at the intersection between the legs of the L-shape, the recess (2302) for cooperating with the spring (140, 240) being provided at one leg of the L-shape and the curved surface (2303) facing the sliding joint (222, 122) of the other hinge part (200, 100) on the other.

8. A hinge according to claim 6, wherein each pick-up element (130, 230) is formed as a substantially longitudinal element and the second hinged joint (131, 231) is provided at one end and the recess (1302) for cooperating with the spring (140, 240) at the other, the curved surface (2303) facing the sliding joint (122) of the other hinge part (100) being provided at a top edge between the ends of the pick-up element (130, 230).

9. A hinge according to claim 1, wherein each link (120, 220) is formed as an angular element with an apex and two legs, the bearing axle (123) being provided at the apex and the first hinged joint (121, 221) being provided at one leg, and the sliding joint (122, 222) at the other leg.

10. A hinge according to claim 1, wherein the sliding joint (222) comprises a pin (2221) connected to a substantially rectangular block (2222) slidably received in the guide track (112) of the other hinge part (100) and a wheel (2223) interacting with the curved surface (1303) of the pick-up element (130).

11. A hinge according to claim 10, wherein the wheel (2223) of the sliding joint (222) and/or the curved surface (1303) of the pick-up element (130) is/are provided with force transmitting means, preferably as a toothed gear or a rack-and-pinion transmission.

12. A hinge according to claim 1, wherein the sliding joint (222, 122) comprises two components, where the first component is a block (222*a*) which is preferably made of a POM/PTFE composite, and the second component is a block (222*b*), which is preferably made of PA6 with fibre glass reinforcement.

13. A hinge according to claim 1, wherein at least one of the frame hinge part (100) and the sash hinge part (200) comprises a mounting plate (101, 201) for connection to the base plate (110, 210) by means of connection means (104, 204).

14. A hinge according to claim 13, wherein the connection means (104) of the frame hinge part (100) is releasable such that the mounting plate (101) is adapted to be fastened separately to the frame of the roof window and the remaining components of the hinge including the base plate (110) are adapted to be connected to the mounting plate (101) in a subsequent operation.

15. A hinge according to claim 1, wherein the pick-up element (130) is provided with a curved surface (132) to interact with a straight portion (142) of the spring (140), the pick-up element (130) being preferably provided with a recess (133) to accommodate an end portion (143) of the spring (140).

16. A hinge according to claim 1, wherein a stop (125) is provided on one or both links (120, 220) to interact with a well-defined surface (2205) on the other link (220, 120).

17. A roof window, comprising:

a frame (1) having a top member, a bottom member and two side members (la) defining a frame plane, a sash (2) having a top member, a bottom member and two side members (2*a*), said sash carrying a pane (3) and defining a sash plane, said set of hinges (10) defining a hinge axis (α) of the window; and, a set of hinges, at least one hinge of said set of hinges including a frame hinge part (100) and a sash hinge part (200) configured to assume an angle relative to the frame hinge part (100), the frame hinge part (100) and the sash hinge part (200) each comprising a base plate (110, 210) with a guide track (112, 212) and a link (120, 220), the links (120, 220) being connected to each other at a bearing axle (123), each link (120, 220) including a first hinged joint (121, 221) to the respective base plate (110, 210) and a sliding joint (122, 222) slidably received in the guide track (212, 112) in the base plate (210, 110) of the other hinge part (200, 100), at least one hinge part (100, 200) is provided with a pick-up element (130, 230; 135) biased by a spring (140, 240) to act on a selected part of the hinge (10), said selected part of the hinge (10) being the sliding joint (222, 122) of the other hinge part (200, 100) in the guide track (112, 212), that the pick-up element (130, 230) is connected to the base plate (110, 210) in a second hinged joint (131, 231) and acts on the sliding joint (222, 122) of the other hinge part (200, 100), and that the pick-up element (130, 230) acts on the sliding joint (222, 122) only within a predefined angle interval.

18. A roof window according to claim 17, wherein a plurality of pick-up elements (130; 130'; 130"; 130'"; 230) is provided, each pick-up element of said plurality having a curved surface (1303) comprising an apex point (1304), a first inclined portion (1305), at least one groove point (1306), and a second inclined portion (1307), and wherein the curved surface (1303) has a configuration adapted to a specific range of roof inclinations.

19. A roof window according to claim 17, wherein the hinge axis (α) is located between a centre axis and the top of the roof window, in the interval ⅓ to ⅔ of the distance between the centre axis and the top.

20. A roof window according to claim 17, wherein the sash is connected to an intermediate frame by said set of hinges, said intermediate frame being connected to the frame via a top hinge connection, allowing the sash to rotate with the intermediate frame about a hinge axis at the top, and to pivot relative to the intermediate frame.

21. A roof window according to claim 17, in which the set of hinges comprises a total of 1 to 8 pick-up elements.

* * * * *